US005678120A

United States Patent [19]

Redden

[11] Patent Number: 5,678,120

[45] Date of Patent: Oct. 14, 1997

[54] METHOD AND APPARATUS FOR PROCESSING A PHOTOSENSITIVE MATERIAL

[75] Inventor: John Edward Redden, Rochester, N.Y.

[73] Assignee: Eastman Kodak Company, Rochester, N.Y.

[21] Appl. No.: 625,439

[22] Filed: Mar. 27, 1996

[51] Int. Cl.[6] ..... G03D 3/02

[52] U.S. Cl. ..... 396/630; 396/632; 396/633; 396/601

[58] Field of Search ..... 354/297, 298, 354/308, 310, 313, 317, 319–325, 330, 331, 336; 118/19, 303, 313, 684; 134/18, 25.2; 355/283; 427/8, 212, 424, 74; 366/152.2, 152.3, 160.1, 160.2; 396/564, 569, 570, 626, 630, 633, 632, 601

[56] References Cited

U.S. PATENT DOCUMENTS

| | | | |
|---|---|---|---|
| 2,411,457 | 11/1946 | Patterson | 116/109 |
| 3,392,708 | 7/1968 | Hunstiger | 396/564 |
| 3,796,412 | 3/1974 | Maurer | 366/160.2 |
| 3,978,506 | 8/1976 | Geyken et al. | 396/630 |
| 4,341,633 | 7/1982 | Walder | 210/614 |
| 5,330,580 | 7/1994 | Whipple, III et al. | 134/18 |
| 5,543,882 | 8/1996 | Pagano et al. | 354/311 |

*Primary Examiner*—D. Rutledge

*Attorney, Agent, or Firm*—Frank Pincelli

[57] ABSTRACT

A method and apparatus for processing a photosensitive material. The apparatus has a processing tank for holding and retaining a processing solution, an agitation propeller, and a motor for driving said agitation propeller so as to move the processing solution. The apparatus includes a device for monitoring a characteristic feature of the motor which can be correlated to the level of the processing fluid within the processing tank.

9 Claims, 4 Drawing Sheets

METHOD AND APPARATUS FOR PROCESSING A PHOTOSENSITIVE MATERIAL

FIELD OF THE INVENTION

The present invention relates to the processing of a photosensitive material and more particularly to an apparatus for processing photosensitive film while the film is still attached to the film cartridge.

BACKGROUND OF THE INVENTION

Traditional methods for processing photosensitive film contained in cartridges typically involves the separation of the filmstrip from the cartridge prior to processing. In one method, the photographic film is cut away from the cartridge and taped to a leader board, or a length of flexible film, after which the film is drawn through a series of tanks containing the required processing solutions. This method has satisfied the reliability and efficiency requirements for the traditional photofinishing systems largely due to the fact that the film cartridge is discarded and thus no longer serves any other purposes in subsequent stages of image preparation, storage, and retrieval.

Recent advances in film cartridges, such as described in U.S. Pat. No. 4,834,306, disclose a photographic film cartridge wherein the filmstrip may be thrust out of the cartridge and retracted back into the cartridge a number of times (hereinafter referred to as thrust film cartridge). For example, the thrust film cartridge can be used as a primary storage for the processed film, and can be used with related film handling equipment which can be configured to accept the thrust-type film cartridge. The ability to execute other tasks involved in the preparation, storage, and retrieval of images from a specific filmstrip cartridge is advantageous to the photographer and to the photofinisher. In particular, the method of identifying, sorting, and preferentially reproducing (e.g., selecting desired print parameters; such as frame number, size, quantity, setup, and balancing data) images may be significantly enhanced. It has been proposed that the thrusting filmstrip be detached from the thrust film cartridge prior to chemical processing and processed in the traditional photofinishing equipment and then reattached to the original film cartridge (or similar cartridge) for storage.

The detached method exhibits a number of inherent disadvantages. Specifically, the correct filmstrip and cartridge must be reunited; detaching and reattaching the filmstrip can result in damage to the leader and/or trailing edge of the film which then must be cut and reshaped which adds cost to the process; reattaching of the film can be difficult and require certain standardized equipment. Additionally, the detached system cannot take advantage of the fact that only partial portions of the film may be exposed and developed without exposing the remaining portion of the film in the cartridge.

U.S. Pat. No 5,093,686 discloses the processing of photosensitive material while the filmstrip is still connected to the film cartridge. This is accomplished by thrusting the film out of the cartridge and dipping the filmstrip into successive tanks, typically referred to as the dip and dunk process. The device includes a vertical transport mechanism for lifting the film up to a horizontal transport position where the film can then be moved horizontally while the film is still extended from the cartridge. This type of process results in the images at the bottom end of the strip to experience more development time than the portions above. Additionally, further expensive equipment is required to move and transport the film through the system.

One solution to the foregoing problem is disclosed in U.S. Ser. No. 08/330,271, filed Oct. 27, 1994, now U.S. Pat. No. 5,543,882, by Daniel M. Pagano, Richard B. Wheeler, and Kevin J. Klees, entitled "Method and Apparatus for Processing Photosensitive Film", which is hereby incorporated by reference. In this application there is provided a plurality of individual processing tanks through which film contained in the reel is excessively packed. The film contained in the spiral wheel is positioned within each of the tanks and a propeller, which is immersed in the developing fluid causing processing fluid to be driven past the film. This processing tank has proven to provide excellent developing uniformity. However, in such a device it is important to maintain the fluid level at a predetermined level above the propeller. One method of monitoring fluid level can simply be the providing of a liquid fluid level sensor within the tank. However, this requires additional sensors, thus requiring additional manufacturing costs and maintenance.

The present invention provides a method and apparatus for monitoring the fluid level within the liquid processing tank, which does not require any additional hardware, thus avoiding the need for additional parts, thus reducing costs and maintenance of the device.

SUMMARY OF THE INVENTION

A method and apparatus for processing a photosensitive material. The apparatus has a processing tank for holding and retaining a processing solution, an agitation propeller, and a motor for driving said agitation propeller so as to move the processing solution. The apparatus includes a device for monitoring a characteristic feature of the motor which can be correlated to the level of the processing fluid within the processing tank.

These and other advantages of the present invention will be more clearly understood and appreciated from a review of the following detailed description and appended claims, and by reference to the accompanying drawings.

DETAILED DESCRIPTION OF THE INVENTION

Figure 1:
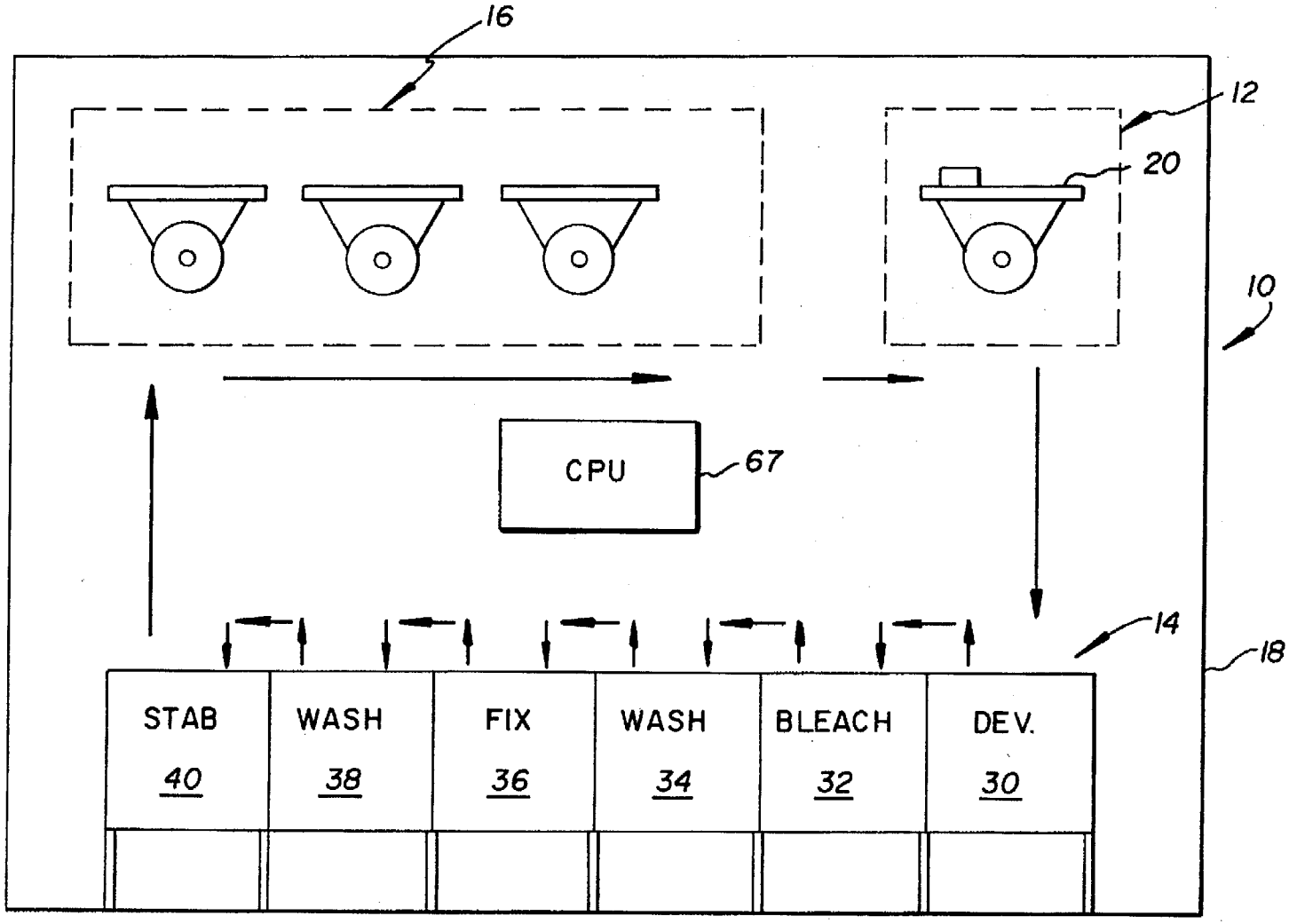
FIG. 1 is a diagrammatic representation of an apparatus made in accordance with the present invention.
Figure 2:
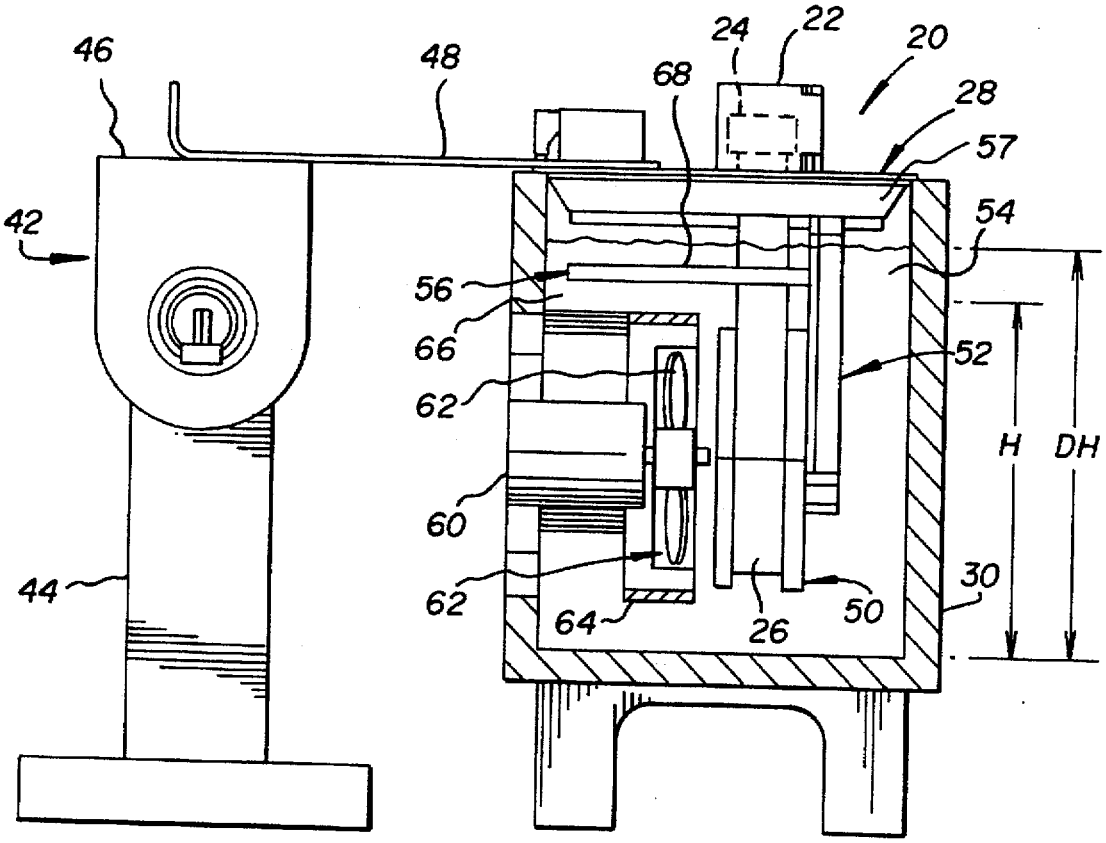
FIG. 2 is a partial sectional view of the processing section of the apparatus of FIG. 1 illustrating a processing tank, processing fluid, and propeller.

Referring to FIGS. 1 and 2, there is illustrated in schematic form a processing apparatus 10 made in accordance with the present invention. The apparatus 10 is designed to process photosensitive material, such as photographic film. In the particular embodiment illustrated, the apparatus is particularly adapted for processing photosensitive film that has been provided in a film thrust-type cartridge such as disclosed in U.S. Pat. No. 4,834,306, commonly assigned to the assignee of the present application and which is hereby incorporated by reference. The apparatus 10 includes a load/unload station 12, a film processing section 14, and a drying section 16. As is typical with such processing apparatus, a housing 18 is provided for containing the load/unload station, film processing section and drying section, and for providing a light-tight environment within the housing 18. Housing 18 is appropriately sized and configured so as to fully enclose the components and allow access as required. A detailed description of the apparatus 10 and its operation is described in U.S. Ser. No. 08/330,271, filed Oct. 27, 1994, now U.S. Pat. No. 5,543,882, by Daniel M. Pagano, Richard B. Wheeler, and Kevin J. Klees, entitled "Method and Apparatus for Processing Photosensitive Film", which has previously been incorporated herein by reference. The apparatus 10 is designed such that it is possible to process film while the filmstrip is still attached to a film cartridge.

In the embodiment illustrated, six processing tanks are provided. In particular, there is provided a development tank 30 which contains a photographic developer solution, a bleach tank 32 containing a photographic bleach solution, a first wash tank 34 containing a wash solution, a fix tank 36 containing a fixing solution, a second wash tank 38 containing a wash solution, and a stabilizer tank 40 containing a stabilizing solution. It is, of course, understood that any desired number of processing tanks may be provided, each containing the desired processing solution.

Referring to FIG. 2, there is illustrated a holding mechanism 20 having nest 22 for holding a film cartridge 24. The cartridge 24 is of the thrust type and contains a filmstrip 26. The holding mechanism further includes a cover 28 designed to mate with each of the processing tanks.

Figure 3:
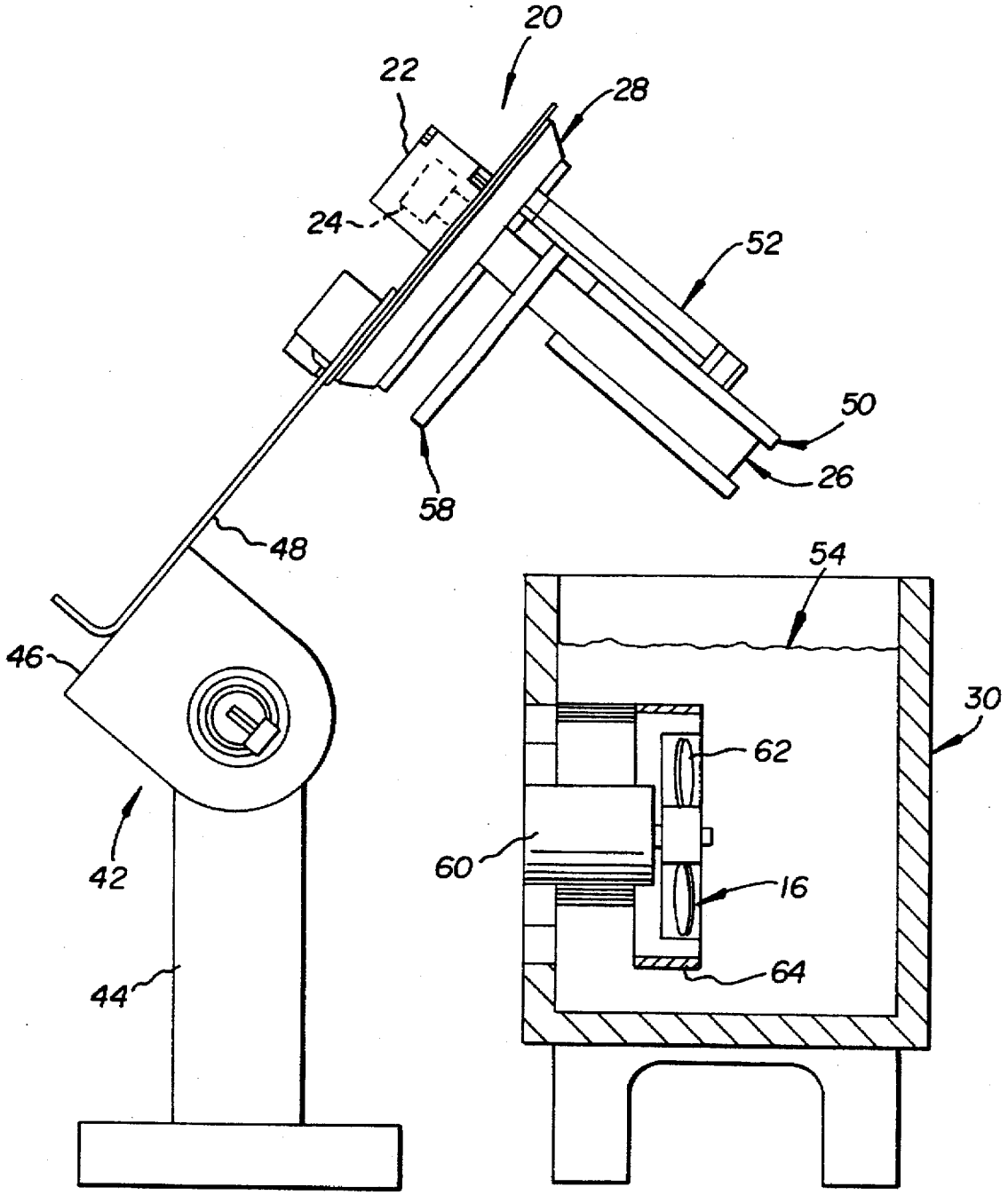
FIG. 3 is a view similar to FIG. 2 showing the holding reel and tank cover in the out of tank position.

A transport mechanism 42 is provided for transporting the holding mechanism 20 through each of the processing tanks 30,32,34,36,38,40. The transport mechanism includes a base 44 secured to apparatus 10, a mounting block 46 which is rotatably mounted to base 44, and a lift member 48 having one end secured to mounting block 46 and the other end secured to holding mechanism 20. The mounting block 46 is mounted to base 44 such that the holding mechanism 20 may be rotated between an operative position (as shown in FIG. 2) and the transport position (as illustrated in FIG. 3). The mounting block 46 is also capable of being moving in a direction such that the holding mechanism 20 will be moved to a position adjacent to each of the processing tanks 30,32,34,36,38,40. Further details of the transport mechanism 42 and holding mechanism 20 are set forth in the previously referred to Ser. No. 08/330,271, now U.S. Pat. No. 5,543,882, of Pagano, Klees and Wheeler.

The holding mechanism 20 further includes a reel 50 which is used to hold the portion of filmstrip 26 that has been thrusted out of cartridge 24 for processing. The filmstrip 26 is held in a spiral pattern, such that the processing solution can flow between adjacent convolutions of the filmstrip while it is transported through a sequence of processing tanks. A support arm 52 connects reel 50 with tank cover 28. Fluid 54 fills tank 30 to a level between the top of reel 50 and the bottom of tank cover 28. Appropriate means (not shown) is provided for thrusting the portion of filmstrip 26 to be processed out of the cartridge 24 and into reel 50 and then back into cartridge 24, such as described in copending application Ser. No. 08/330,271. The trailing end portion of filmstrip 26 is attached to cartridge 24 as it is being processed. A baffle 56 is attached to support arm 52 and placed above reel 50, but below the top level of fluid 54. A slot (not shown) is used to pass film 26 through baffle 56 and onto reel 50.

Means are provided for agitating and passing the processing solution adjacent the surface of the film while in reel 50 in each of the tanks 30,32,34,36,38,40. For the sake of clarity, only the agitation means provided in tank 30 will be discussed, it being understood that similar means may be provided in each of the other tanks. In particular, there is provided a motor 60 having a propeller 62 for providing agitation and causing the processing solution 54 to pass through the reel 50 such that the processing solution 54 is continuously allowed to flow past the emulsion placed on the filmstrip 26. The cover 28 mates with the upper end of the tank so as to provide a substantially sealed processing tank such that when the motor 60 is activated, the processing solution will be maintained within the processing tank. A shroud 64 is provided around the periphery of propeller 62 so as to direct the processing solution to reel 50. In the embodiment illustrated, a baffle 56 is provided for minimizing surface turbulence.

Figure 4:
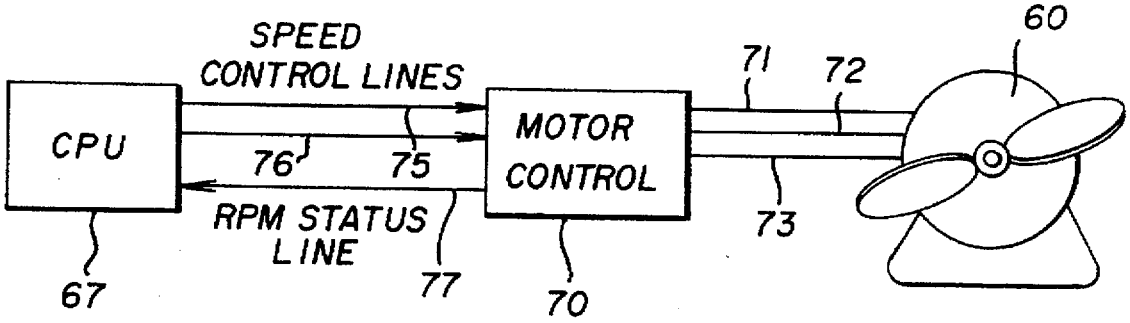
FIG. 4 is a schematic illustration of the central processing unit, motor control, and the propeller motor of the apparatus of the present invention.

Referring to FIG. 4, there is illustrated in greater detail the computer (CPU) 67 and motor control 70 used to control the speed of propeller 62 connected to motor 60. The CPU 67 also controls the operation of apparatus 10 and its various other components. The motor 60 is connected to motor control 70 by appropriate control wires 71,72,73. In turn, the motor control 70 is connected to CPU 67 by appropriate wires 75,76,77. The motor control 70 provides the appropriate electrical power to motor 60. The lines 75,76 from CPU 67 to motor control 70 provide the appropriate controls for activating motor control 70 as required and wire 77 provides appropriate information to the CPU 67 for determining the rotational speed of the propeller 62. Applicants have found that by monitoring the propeller rpm, either directly or indirectly, the fluid level within the processing tank can be accurately monitored. The apparatus produces an alarm or other action if the processing solution within any of the tanks falls below a predetermined level. Applicants have found that noticeable increases in turbulence in the fluid occurs when the fluid level drops. As the fluid level falls, the motor load drops. This results in a corresponding rise in propeller rpm. When the fluid level falls below a predetermined level in the tank, the undesirable effect of excessive oxidation of the processing fluid can occur. Thus, it is important to avoid this from occurring. Applicants have found that fluid level can be monitored by interpreting the propeller rpm data that is being provided to the CPU 67.

In one method, CPU 67 takes multiple samples of the propeller rpm and calculates the statistical sample standard deviation of the samples. The CPU 67 is programmed to monitor the standard deviation in accordance with the following relationship:

$$\sigma = \sqrt{\Sigma(X-\mu)^2/(n-1)}$$

where:

$\sigma$ is the standard deviation;

X is each sample rpm;

$\mu$ is the mean of all rpm samples; and n is the number of rpm samples.

Figure 5:
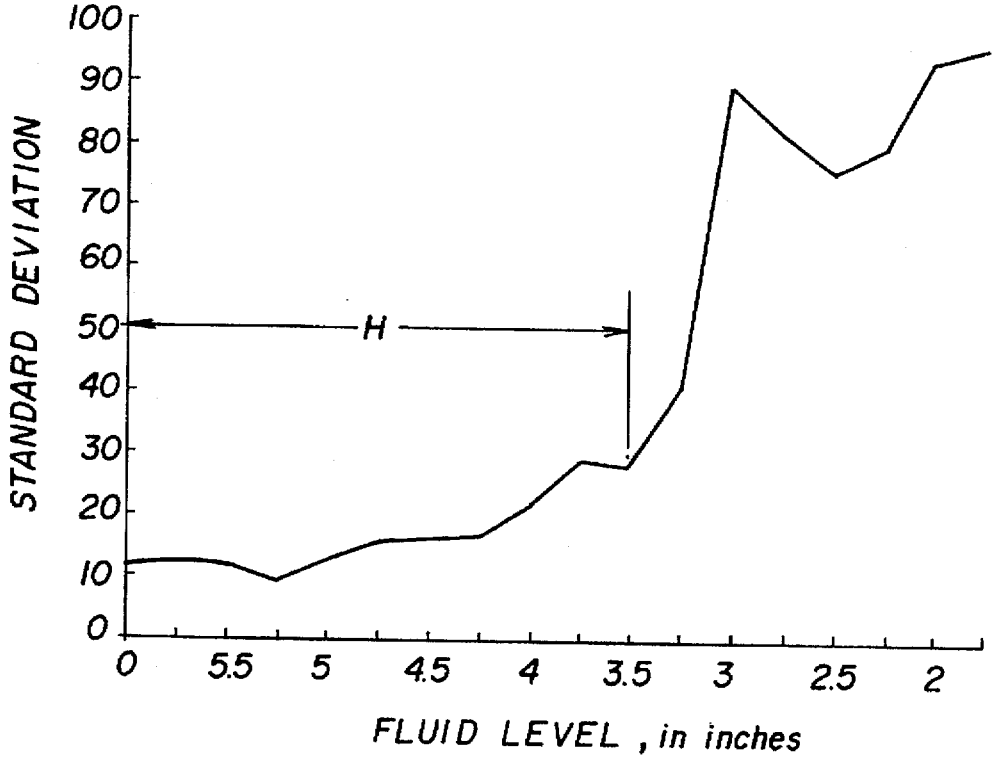
FIG. 5 is a chart illustrating the fluid level within the processing tank verses the standard deviation of the rpm of the motor in relationship thereto.

Referring to FIG. 5, there is illustrated a graphical representation of the fluid level FL as it relates to the standard deviation $\sigma$ of the propeller rpm as calculated using the above relationship. It can be seen that when the fluid reaches a fluid level H, that a significant increase in standard deviation of the propeller rpm occurs. In the particular embodiment illustrated, the desirable fluid height fluid level DH is approximately 5.75 inches (14.6 cm). However, when the fluid level falls below a height H of 3.5 (8.89 cm), a significant increase in standard deviation of the propeller rpm is noted. Thus, it can be seen from this chart that the fluid level, when it goes below height H, can be easily monitored by measuring the standard deviation of propeller rpm. Since this can all be done by appropriate programming of a central processing unit, no additional hardware is required for monitoring the fluid level. Alternatively, this method can be used as a backup to other fluid levels since there is the providing of safe and assured fluid levels within the tank. It is, of course, understood that the particular graphical representation for each tank will vary according to its own particular construction. The graph illustrated in FIG. 5 was empirically determined, which can be done for any other appropriately sized and configured tank. Thus, it is only necessary to vary the height of the fluid and measure the motor rpm to obtain a graphical representation as illustrated in FIG. 5 for any tank configuration desired. From this graph, the appropriate level where a distinct change in rpm or standard deviation occurs can be determined.

When the fluid level falls below the minimal height H, an alarm can be set off advising the operator that this has occurred. In addition, the device may be automatically shut off, or appropriate additional solution can be added until CPU 67 no longer monitors a fluid level that is too low.

In the preferred method, the standard deviation is monitored as this provides a very distinct demarcation between acceptable fluid levels and unacceptable fluid levels. However, if desired, the threshold fluid level H can be determined directly by monitoring the propeller rpm. As the fluid level drops below the level of the propeller, the load on the motor is correspondingly reduced. This causes the motor 60 to accelerate. As the fluid level continues to drop, this relationship holds until the propeller motor is no longer loaded by fluid at all. When the CPU detects an overspeed condition in the motor/propeller assembly, it automatically shuts the motor 60 off and provides an appropriate fault condition which can be attended to by the operator.

Thus, the present invention provides a reliable fluid detection system at no additional cost and thus avoids erratic image quality caused by improper fluid levels and damages rotating equipment caused by excessive speed.

It is to be understood that various other changes and modifications may be made without departing from the scope of the present invention. The present invention being limited by the following claims.

Parts List:

10 . . . processing apparatus
12 . . . load/unload station
14 . . . film processing section
16 . . . drying section
18 . . . housing
20 . . . holding mechanism
22 . . . nest
24 . . . film cartridge
26 . . . filmstrip
28 . . . tank cover
30 . . . development tank
32 . . . bleach tank
34 . . . first wash tank
36 . . . fix tank
38 . . . second wash tank
40 . . . stabilizer tank
42 . . . transport mechanism
44 . . . base
46 . . . mounting block
48 . . . lift member
50 . . . reel
52 . . . support arm
54 . . . fluid
56 . . . baffle
60 . . . motor
62 . . . propeller
64 . . . shroud
67 . . . CPU
70 . . . motor control
71,72,73 . . . control wires
75,76,77 . . . wires

I claim:

1. A processing apparatus for processing a photosensitive material, said apparatus having a processing tank for holding and retaining a processing solution, an agitation propeller, and a motor for driving said agitation propeller so as to move the processing solution, characterized by:

means for monitoring a characteristic feature of the motor which can be correlated to the level of the processing fluid within the processing tank.

2. A processing apparatus according to claim 1 wherein said means for monitoring comprises a CPU.

3. A processing apparatus according to claim 1 wherein said characteristic feature comprises monitoring the standard deviation of the motor rpm.

4. A processing apparatus according to claim 1 wherein said characteristic feature comprises monitoring the motor rpm.

5. A method of monitoring the fluid level in a processing tank in a processor for processing photosensitive material, said processing tank includes an agitation propeller and motor for driving the agitation propeller, the method comprising:

monitoring a characteristic feature of the motor which can be correlated to the level of the processing fluid within the processing tank.

6. A method according to claim 5 wherein said characteristic feature comprises monitoring the standard deviation of the motor rpm.

7. A method according to claim 5 wherein said characteristic feature comprises monitoring the motor rpm.

8. An apparatus for processing a filmstrip contained in a film cartridge, said filmstrip having a trailing end secured to the cartridge, said apparatus comprising:

at least one processing tank containing a processing solution therein;

a holding mechanism for holding and retaining a film cartridge containing a filmstrip, said holding mechanism includes a reel for receiving and holding a portion of the filmstrip as it exits the film cartridge, said reel capable of being positioned within said at least one processing tank so that the filmstrip can be submerged within the processing solution contained in said at least one processing tank;

an agitation mechanism comprising a motor and a propeller connected to said motor, said propeller being disposed within said tank for agitating the processing solution contained in said tank; and means for monitoring the fluid level within said tank by monitoring, said means comprising means for monitoring a characteristic feature of the motor rpm.

9. An apparatus according to claim 8 wherein said means for monitoring the motor rpm comprises a CPU.

* * * * *